US010871726B2

(12) United States Patent
Mori

(10) Patent No.: US 10,871,726 B2
(45) Date of Patent: Dec. 22, 2020

(54) IMAGE FORMING APPARATUS

(71) Applicant: CANON KABUSHIKI KAISHA, Tokyo (JP)

(72) Inventor: Kota Mori, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/393,212

(22) Filed: Apr. 24, 2019

(65) Prior Publication Data

US 2019/0346786 A1 Nov. 14, 2019

(30) Foreign Application Priority Data

May 10, 2018 (JP) ..... 2018-091550

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 2215/025
See application file for complete search history.

(56) References Cited

U.S. PATENT DOCUMENTS 10,268,132 B2 4/2019 Fujino et al.
2008/0292366 A1* 11/2008 Akama ..... G03G 15/0818 399/286
2011/0008070 A1* 1/2011 Sato ..... G03G 15/0233 399/176
2016/0154366 A1* 6/2016 Yamauchi ..... G03G 15/0233 399/176
2018/0364605 A1 12/2018 Yoshida et al.

FOREIGN PATENT DOCUMENTS

JP 2006-243375 A 9/2006
JP 2007-178559 A 7/2007
JP 2010-096267 A 4/2010

OTHER PUBLICATIONS

Maejima et al., U.S. Appl. No. 16/393,224, filed Apr. 24, 2019.
Fujino et al., U.S. Appl. No. 16/393,240, filed Apr. 24, 2019.

* cited by examiner

*Primary Examiner* — Gregory H Curran
(74) *Attorney, Agent, or Firm* — Venable LLP

(57) ABSTRACT

An image forming apparatus includes an image bearing member configured to bear an image and a charging roller to which a direct current voltage is applied and which is configured to charge a surface of the image bearing member. The charging roller includes a shaft member, an elastic layer formed around the shaft member, and a surface layer formed around the elastic layer. Particles having particle diameters within a range of 2 μm or larger and 15 μm or smaller are dispersed in the surface layer. A maximum height Sz (μm) and an autocorrelation length Sal (μm) with respected to the surface layer of the charging roller satisfy $8 \leq Sz \leq 16$ and $13 \leq Sal \leq 30$.

12 Claims, 2 Drawing Sheets

IMAGE FORMING APPARATUS

BACKGROUND OF THE INVENTION

Field of the Invention

The present invention relates to an image forming apparatus including a charging roller configured to charge an image bearing member in an electrophotographic process.

Description of the Related Art

For a charging unit configured to charge an image bearing member in an image forming apparatus of an electrophotographic system, a contact charging system in which a voltage is applied to a charging roller brought into contact with the image bearing member is widely used. Such a charging roller is known to be capable of suppressing abnormal electrical discharge, which leads to deterioration of image quality, by smoothing the surface thereof. Meanwhile, in the case where the smoothness of the charging roller is too high, the contact area between the charging roller and soiling matter such as toner attached to the image bearing member increases, thus a filming phenomenon in which the soiling matter attaches to the charging roller becomes more likely to occur, and as a result the lifetime of the charging roller sometimes becomes shorter.

Conventionally, a technique of imparting appropriate surface roughness to a charging roller to extend the lifetime of the charging roller while suppressing abnormal electrical discharge to an acceptable level or lower is known. Japanese Patent Laid-Open No. 2010-096267 discloses a charging roller having a surface roughness of 2 to 15 μm and configured such that the sum of frequencies below the mode and the sum of frequencies equal to or above the mode in a frequency distribution of surface height of the charging roller has a predetermined ratio. This surface roughness specified in the document above is ten point height of roughness profile Rzjis defined in Japanese Industrial Standards JIS B0601 (1994). According to the document above, by setting the surface roughness to such a value, transfer of toner particles from a photosensitive drum to a projecting portion of the charging roller is suppressed, and thus occurrence of filming is suppressed.

In recent years, accompanied by increase in the durability of a photosensitive drum used as an image bearing member, it is requested that the charging roller also maintains its performance for a long period of time. According to the study by the inventors, it has been found that not only filming caused by attachment of toner, that is, toner filming, but also filming caused by attachment of particles smaller than toner particles is a problem. A typical example of the particles smaller than the toner particles is an external additive added to developer.

When filming caused by attachment of an external additive detached from toner particles to the charging roller, that is, external additive filming occurs, typically an image defect occurs as a high-density streak in a halftone image. However, as found by intensive study by the inventors, the image defect caused by the external additive filming cannot be effectively suppressed by the configuration disclosed in the document above. In addition, although a good tendency can be seen when the surface roughness of the charging roller is set larger to suppress toner filming, in the case where a direct current charging system: DC charging system is employed, there is a tendency that the uniformity of halftone decreases when the surface roughness of the charging roller is increased. That is, it has been found that, in the case of the DC charging system, there is a trade-off relationship between the suppression of the toner filming and the uniformity of the halftone.

SUMMARY OF THE INVENTION

The present invention provides an image forming apparatus adopting the DC charging system that can maintain an improved filming resistance for a long period while suppressing degradation in the uniformity of the halftone.

According to one aspect of the invention, an image forming apparatus includes: an image bearing member configured to bear an image; and a charging roller to which a direct current voltage is applied and which is configured to charge a surface of the image bearing member. The charging roller includes a shaft member, an elastic layer formed around the shaft member, and a surface layer formed around the elastic layer. Particles having particle diameters within a range of 2 μm or larger and 15 μm or smaller are dispersed in the surface layer. A maximum height Sz (μm) and an autocorrelation length Sal (μm) with respected to the surface layer of the charging roller satisfy $8 \leq Sz \leq 16$ and $13 \leq Sal \leq 30$.

Further features of the present invention will become apparent from the following description of exemplary embodiments with reference to the attached drawings.

DESCRIPTION OF THE EMBODIMENTS

Embodiments of the present invention will be described below with reference to drawings.

Image Forming Apparatus

Figure 1:
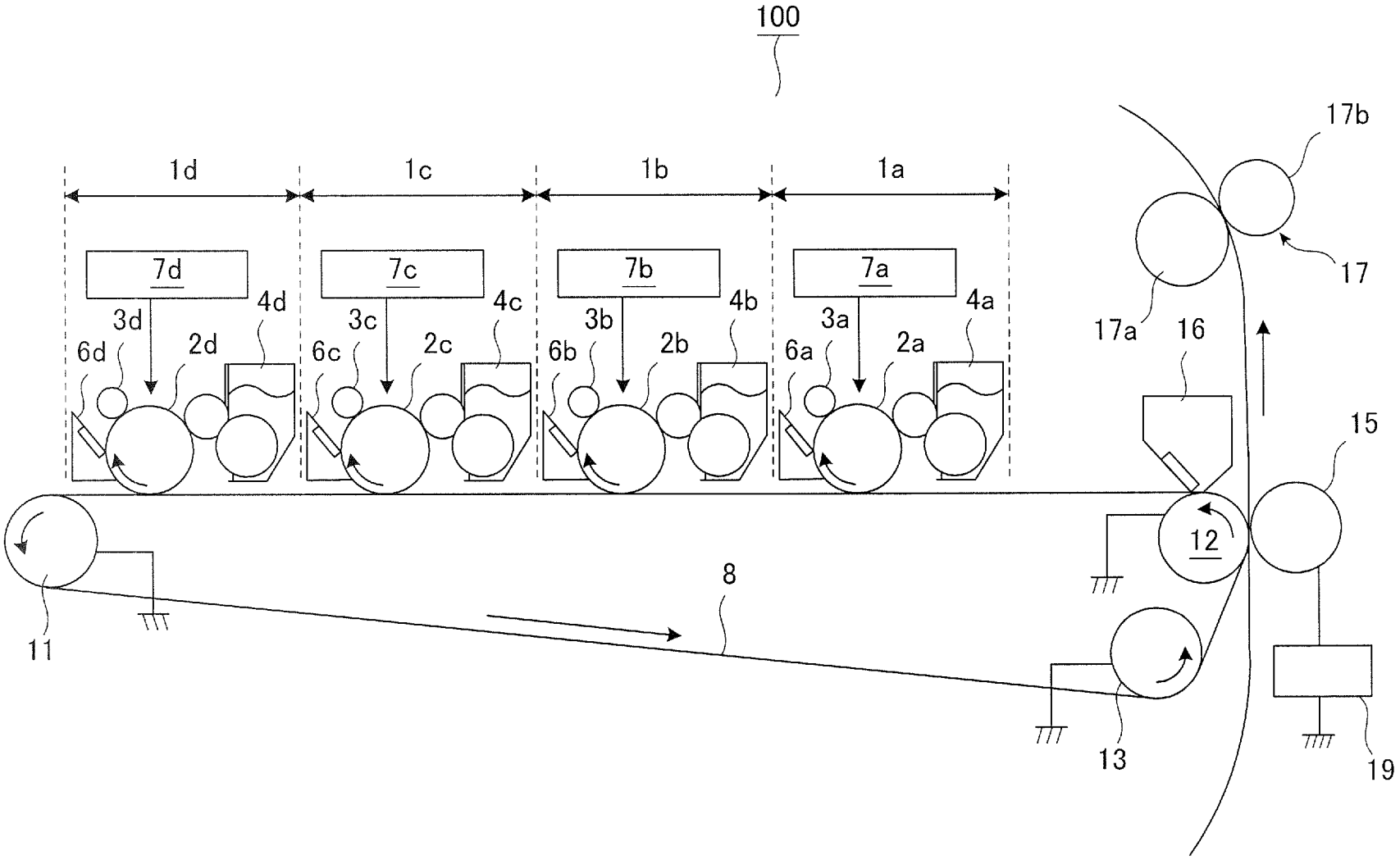
FIG. 1 is a schematic diagram illustrating a configuration of an image forming apparatus according to the present disclosure.

FIG. 1 is a configuration diagram of an image forming apparatus 100 of a 4-drum in-line system. The image forming apparatus 100 includes four image forming units 1*a*, 1*b*, 1*c*, and 1*d* that respectively form images of yellow, magenta, cyan, and black. The four image forming units 1*a*, 1*b*, 1*c*, and 1*d* are arranged in a line with equal intervals therebetween.

The image forming units 1*a* to 1*d* respectively include photosensitive drums 2*a*, 2*b*, 2*c*, and 2*d* serving as image bearing members. The photosensitive drums 2*a* to 2*d* each have a photosensitive layer of an organic photoconductor: OPC having a negative charging polarity on a base drum body of aluminum or the like, and are each rotationally driven by a driving unit at a predetermined process speed.

Charging rollers 3*a*, 3*b*, 3*c*, and 3*d*, developing units 4*a*, 4*b*, 4*c*, and 4*d*, and drum cleaning units 6*a*, 6*b*, 6*c*, and 6*d* are respectively disposed around the photosensitive drums 2*a* to 2*d*. Further, exposing units 7*a*, 7*b*, 7*c*, and 7*d* are respectively disposed above the photosensitive drums 2*a* to 2*d*. The developing units 4*a* to 4*d* respectively accommodate developers containing yellow, cyan, magenta, and black toners.

The image forming units 1*a* to 1*d* are each preferably configured as a cartridge attachable to and detachable from an apparatus body of the image forming apparatus 100. The cartridges according to the present exemplary embodiment at least respectively include the photosensitive drums 2*a* to 2*d* and the charging rollers 3*a* to 3*d*. These cartridges may be also configured as process cartridges further respectively including the developing units 4*a* to 4*d* and the drum cleaning units 6*a* to 6*d*.

An intermediate transfer belt 8 that is a rotatable endless belt is disposed at a position opposing the photosensitive drums 2*a* to 2*d* of the respective image forming units. The intermediate transfer belt 8 serving as an intermediate transfer body is stretched over a driving roller 11, a secondary-transfer opposing roller 12, and a tension roller 13. The intermediate transfer belt 8 is driven by the driving roller 11 connected to a motor, and is thus rotated in an arrow direction, that is, in the counterclockwise direction. The secondary-transfer opposing roller 12 abuts a secondary transfer roller 15 with the intermediate transfer belt 8 therebetween, and thus forms a secondary transfer portion.

A belt cleaning unit 16 that removes and collects transfer residual toner remaining on the intermediate transfer belt 8 is disposed on the outer circumferential side of the intermediate transfer belt 8. In addition, a fixing unit 17 including a fixing roller 17*a* and a pressurizing roller 17*b* for performing a heating/pressurizing process to fix toner on a recording material is disposed downstream of the secondary transfer portion, in which the secondary-transfer opposing roller 12 and the secondary transfer roller 15 abut with each other, in the rotation direction of the intermediate transfer belt 8.

The photosensitive drums 2*a* to 2*d* serve as image bearing members in the present exemplary embodiment. The charging rollers 3*a* to 3*d* serve as charging rollers for charging the surfaces of the image bearing members in the present exemplary embodiment, and the detailed configuration thereof will be described later. The exposing units 7*a* to 7*d* serve as exposing units for drawing electrostatic latent images on the image bearing members in the present exemplary embodiment. The developing units 4*a* to 4*d* serve as developing units for developing the electrostatic latent images born on the image bearing members in the present exemplary embodiment. A transfer unit including the intermediate transfer belt 8 and the secondary transfer roller 15 serves as a transfer unit for transferring toner images born on the image bearing members onto a recording material in the present exemplary embodiment.

When a start signal to start an image forming operation is output from a controller of the image forming apparatus 100, recording materials are delivered out one by one from a cassette, and are conveyed to a registration roller. The recording material stands by in a state of abutting the registration roller in a stationary state. When the start signal is output, the photosensitive drums 2*a* to 2*d* start rotating at a predetermined process speed in the image forming units 1*a* to 1*d*. The photosensitive drums 2*a* to 2*d* are uniformly charged to a negative polarity respectively by the charging rollers 3*a* to 3*d*. The exposing units 7*a* to 7*d* respectively expose the photosensitive drums 2*a* to 2*d* by scanning the photosensitive drums 2*a* to 2*d* by laser light, and thus form electrostatic latent images on the surfaces of the photosensitive drums 2*a* to 2*d*. These electrostatic latent images are developed as toner images by applying a bias voltage having a negative polarity serving as a developing bias to developer bearing members bearing developer in the developing units 4*a* to 4*d*.

For example, the amount of charge and the amount of exposure are adjusted such that the surface potential of the photosensitive drum is −600 V after being charged by the charging roller and is −200 V at a portion exposed by the exposing unit, that is, at an image portion. The developing bias is set to −500 V. The process speed, which is a driving speed of the photosensitive drum, is 240 mm/sec, and an image formation width, which is a length in a direction perpendicular to the conveyance direction corresponding to the rotation direction, is 300 mm. In addition, the amount of charge of the toner used for developing is set to about −30 μC/g, and the amount of toner in a solid image portion on the surface of the photosensitive drum is set to about 0.4 $mg/cm^2$.

Regarding the order of image formation, first, to form a yellow image, by the developing unit 4*a*, yellow toner is attached to the electrostatic latent image formed on the photosensitive drum 2*a*, and thus the electrostatic latent image is visualized as a toner image. This yellow toner image is transferred onto the rotating intermediate transfer belt 8 through primary transfer.

A region to which the yellow toner image on the intermediate transfer belt 8 has been transferred is moved toward the magenta image forming unit 1*b* by the rotation of the intermediate transfer belt 8. Then, also in the image forming unit 1*b*, the magenta toner image formed on the photosensitive drum 2*b* in a similar manner is transferred so as to be superimposed on the yellow toner image on the intermediate transfer belt 8. Subsequently, cyan and black toner images respectively formed on the photosensitive drums 2*c* and 2*d* of the image forming units 1*c* and 1*d* are sequentially transferred so as to be superimposed on the yellow and magenta toner images that have been already transferred, and thus a full-color toner image is formed on the intermediate transfer belt 8.

Then, the registration roller conveys the recording material to the secondary transfer portion at a timing when the leading end of the full-color toner image born on the intermediate transfer belt 8 reaches the secondary transfer portion. A bias voltage having an opposite polarity to the toner serving as a secondary transfer voltage is applied from a transfer power source 19 to the secondary transfer roller 15. As a result of this, the full-color toner image is collectively transferred from the intermediate transfer belt 8 onto the recording material through secondary transfer at the secondary transfer portion. The recording material onto which the toner image has been transferred is conveyed to the fixing unit 17, and is heated and pressurized in a fixing nip portion formed by the fixing roller 17*a* and the pressurizing roller 17*b*. The toners of respective colors solidify and adhere to the recording material after melting, and thus the image is fixed to the recording material. Then, the recording material is discharged onto a discharge tray provided in the image forming apparatus 100 or to a sheet processing apparatus that performs post-processing such as a binding process on the recording material.

The image forming apparatus 100 described above is an example of an image forming apparatus. For example, a system in which a toner image formed on a photosensitive drum is directly transferred onto a recording material without using an intermediate transfer body may be employed. In addition, examples of the image forming apparatus include printers, copiers, facsimile machines, and multifunctional apparatuses having functions of these.

Surface Roughness of Charging Roller

Here, a relationship between the surface roughness of a charging roller, image quality of an image formed by an electrophotographic process, and the lifetime of the charging roller will be described. Conventionally, a technique is known in which an appropriate surface roughness is imparted to a charging roller, in order to suppress toner attachment to the charging roller and thus improve the durability of the charging roller while suppressing abnormal electrical discharge derived from unevenness of the surface to an acceptable level or lower. As an index of the surface roughness, ten point height of roughness profile Rzjis defined in Japanese Industrial Standards JIS B0601 (1994) is widely used (see Appendix JA of JIS B0601 (2013)).

The diameter of toner used in an electrophotography apparatus is typically 10 μm or smaller, and toner having an average particle diameter (volume average particle diameter) of 4 to 8 μm in terms of volume average particle diameter is often employed. However, when toner is transferred from an image bearing member to an intermediate transfer body or to a recording material, toner particles having larger particle diameters are more likely to be transferred, and toner particles having smaller particle diameters are less likely to be transferred. Therefore, toner remaining on the photosensitive drum without being transferred at a transfer portion contains many small particles, for example, particles having a diameter of 3 μm or smaller. Therefore, it can be assumed that, in the case where, for example, the ten point height of roughness profile Rzjis of the surface of the charging roller is set to 2 μm to 15 μm, the number of contact points between the toner particles attached to the photosensitive drum and the surface of the charging roller decreases, and thus toner attachment to the charging roller is suppressed.

However, it has been found that the filming caused by attachment of an external additive, that is, the external additive filming cannot be effectively suppressed by just controlling the ten point height of roughness profile Rzjis as described above. The reason for this is considered to be because primary particles or secondary particles of the external additive have a particle diameter of several tens nanometers to several hundred nanometers, and behave differently from the toner particles, which have a particle diameter of several micrometers. To be noted, the secondary particles refer to aggregates of the primary particles herein.

More specifically, the reason why the external additive filming cannot be effectively suppressed by just controlling the ten point height of roughness profile Rzjis is considered to be as follows. In the case where fine recesses and projections that are steep are present on the surface of the charging roller, the external additive composed of fine particles is likely to attach to the bottom of the recesses and around the projections, and is unlikely removed even when a cleaning member for cleaning the surface of the charging roller is provided. However, the ten point height of roughness profile Rzjis is defined as a difference between the average of peak heights of the five highest portions in a measurement range and the average of valley depths of the five lowest portions in the measurement range. Therefore, even if the recesses and projections are steep, recesses and projections having small peak heights and small valley depths do not affect calculation of the ten point height of roughness profile Rzjis. Therefore, it can be seen that the ten point height of roughness profile Rzjis is not suitable for measuring the degree of small unevenness related to the external additive filming.

Therefore, in the examples below, configurations that can maintain good image quality for a long period of time are realized by suppressing the external additive filming by defining the surface roughness of the charging roller from a plurality of viewpoints.

External Additive and External Additive Filming

External additive is a general term for referring to organic or inorganic fine particles added so as to attach the outer surfaces of toner particles. Typically, one or a plurality of kinds of external additives are added to a developer of an electrophotography apparatus to improve the fluidity by reducing the attraction between toner particles or to impart a function such as stabilizing charge retention of toner. Examples of particles used as an external additive include silica, titanium oxide, and silane compounds. The external additive is added to and agitated with toner particles formed by a polymerization method, a pulverizing method, or the like, and thus attaches to the surfaces of the toner particles by the effect of Coulomb's force, van der Waals force, or the like.

External additive filming refers to a phenomenon that the external additive peeled off from the surfaces of the toner particles is transferred from the image bearing member onto the surface of the charging roller and is gradually accumulated. However, particles transferred from the image bearing member onto the charging roller include matter other than the external additive such as wear debris of the photosensitive drum and paper dust, and it is possible that these particles are also accumulated on the surface of the charging roller together with the external additive. Therefore, in the present exemplary embodiment, "external additive filming" refers not only to the filming caused by only the external additive but also generally to filming phenomena caused by fine particles having smaller diameters than the average particle diameter of the toner.

Charging System

To be noted, as a method of charging an image bearing member by using a charging roller, a direct current charging system of applying a direct current voltage to the charging roller and an alternate current charging system of applying a voltage in which a direct current voltage and an alternate current voltage are superimposed on one another to the charging roller are known. Among these, in the alternate charging system, electrical discharge in positive and negative directions is repeated at a nip portion at which the image bearing member and the charging roller are charged, and thus the surface potential of the image bearing member settles at a target value. Therefore, according to the alternate charging system, abnormality of the surface shape of the charging roller, unevenness of resistivity, and the like are less likely to appear as image defects. In contrast, according to the direct current charging system, whereas the power source configuration can be simplified as compared with the alternate current charging system, unevenness occurs in the charging potential of the image bearing member and thus image defects are likely to occur in the case where abnormal electrical discharge is caused by abnormality of the surface shape of the charging roller or the like.

That is, the direct current charging system has a characteristic that the influence of external additive filming is more likely to appear as image defects than the alternate current charging system. Therefore, the configurations of charging rollers that will be described in Examples later can be suitably used for electrophotography apparatuses of direct current charging systems. However, since image defects also occur in the alternate current charging system when the external additive filming progresses, the charging rollers that will be described in Examples are also effective for electrophotography apparatuses of alternate current charging systems.

Durability of Image Bearing Member

In addition, in recent years, the durability of the image bearing member has improved by methods such as coating a surface layer of the photosensitive drum with a hard material. By using the charging rollers that will be described in Examples below in combination with an image bearing member having high durability, the lifetime of the cartridge as a whole including the image bearing member or the lifetime of the image forming apparatus as a whole can be extended, and thus the running cost can be reduced.

Examples of an image bearing member having high durability include the following photosensitive drum. A photosensitive layer containing organic photoconductor: OPC is formed on a drum base body of aluminum or the like, and an overcoat layer: OCL is formed on the outer periphery thereof as an outermost layer. The overcoat layer is formed from a resin material having higher wear resistance than the photosensitive layer. In addition, a process of improving the wear resistance by radiating electron beams after forming an overcoat layer containing a polymerizable compound may be performed.

To secure wear resistance of the photosensitive drum, it is preferable that the elastic deformation power of the surface of the photosensitive drum is 47% or more. To be noted, the elastic deformation power is obtained by performing an indentation test by a nanoindentation method defined in ISO 14577, and refers to a ratio of work of elastic deformation to the total work of indenter on a test piece. By setting the elastic deformation power within the range described above, the wear rate of the surface of the photosensitive drum on a rubbing surface of a cleaning blade of a drum cleaning unit or the like can be reduced.

Exemplary Embodiment

Figure 2A:
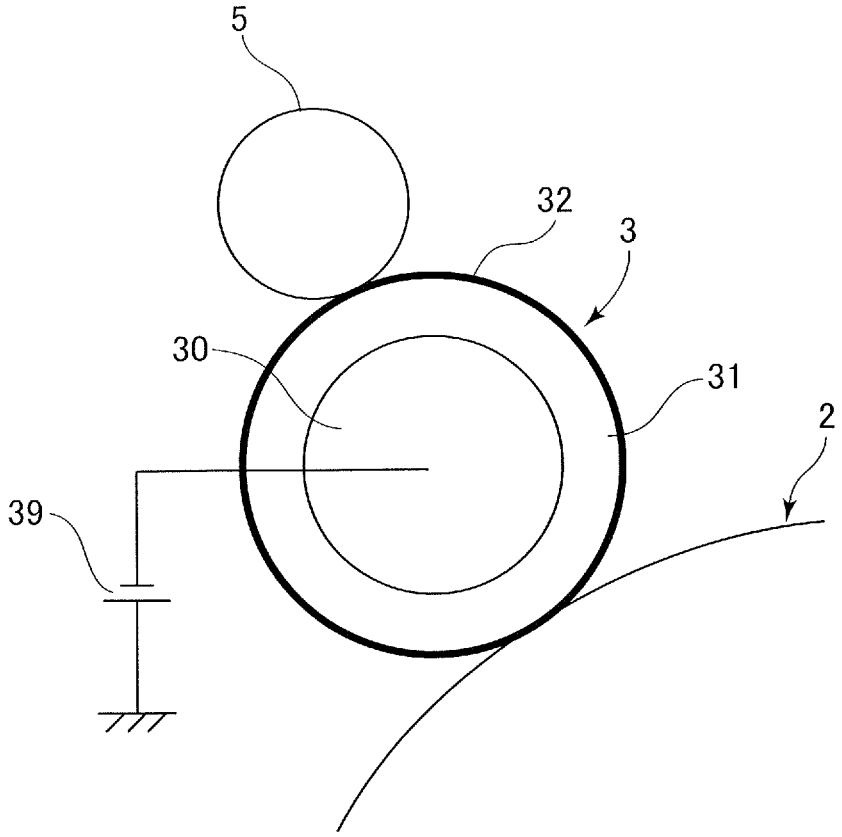
FIG. 2A is a schematic view of a charging roller included in the image forming apparatus.
Figure 2B:
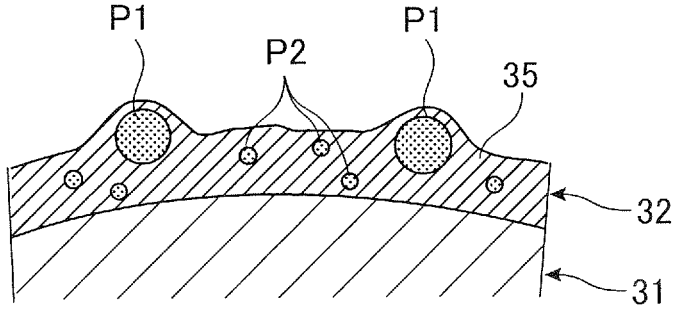
FIG. 2B is a schematic section view of a surface layer of the charging roller.

A charging roller according to an exemplary embodiment will be described below. To be noted, "parts" indicating the amount of constituent material of a member is parts by mass in the description below. FIG. 2A is a section view of a charging roller 3 of this example, and FIG. 2B is a schematic section view of the surface layer. The charging roller 3 can be used as each of the charging rollers 3*a* to 3*d* of the image forming units 1*a* to 1 *d* in the image forming apparatus 100.

The charging roller 3 is disposed to oppose a photosensitive drum 2, and is electrically connected to a charging power source 39 serving as a voltage application unit provided in the image forming apparatus 100. The charging power source 39 includes a voltage generation circuit that generates a direct current charging voltage, and applies the charging voltage to the charging roller 3 on the basis of a command from a controller of the image forming apparatus 100.

In addition, the charging roller 3 is used together with a charging cleaning member 5 if necessary. The charging cleaning member 5 is a member that removes soiling matter attached to the surface of the charging roller 3. Examples of the soiling matter include toner, external additives, wear debris of the photosensitive drum, and paper dust. As the charging cleaning member 5, for example, a rotary member having a brush shape or a sponge roller including a surface layer formed from a foam material can be used.

The charging roller 3 includes a support body 30, an elastic layer 31 formed on the outer periphery of the support body 30, and a surface layer 32 formed on the elastic layer 31. The support body 30 is a shaft member having excellent wear resistance and deflection stress, and one formed from steel plated with nickel can be used. The elastic layer 31 can be formed from a rubber, thermoplastic elastomer, or the like that is conventionally used for the elastic layer of a charging roller. Specifically, rubber compositions containing polyurethane, silicone rubber, butadiene rubber, isoprene rubber, chloroprene rubber, styrene-butadiene rubber, ethylene-propylene rubber, polynorbornene rubber, styrene-butadiene-styrene rubber, epichlorohydrine rubber, or the like as a base rubber, or thermoplastic elastomers can be used. The kinds of the rubber compositions and the thermoplastic elastomers are not particularly limited, and one or more thermoplastic elastomers selected from general-purpose styrene-based elastomers and olefin-based elastomers can be preferably used. In addition, depending on the required elasticity, solid rubber or foam rubber may be used.

Predetermined conductivity can be imparted to the elastic layer 31 by adding a conducting agent thereto. The conducting agent is not particularly limited, and examples thereof include cationic surfactants (such as quaternary ammonium salts like perchlorates, chlorates, fluoborates, ethosulfates, and benzyl halides such as benzyl bromides and benzyl chlorides of lauryltrimethylammonium, stearyltrimethylammonium, octadodecyltrimethylammonium, dodecyltrimethylammonium, and modified-fatty acid-dimethylethylammonium), anionic surfactants (such as aliphatic sulfonate salts, higher alcohol sulfate salts, higher alcohol ethylene oxide-added sulfate salts, higher alcohol phosphate salts, and higher alcohol ethylene oxide-added phosphate salts), amphoteric surfactants (such as betaines), antistatic agents (such as nonionic antistatic agents like higher alcohol ethylene oxides, polyethylene glycol fatty acid esters, and polyol fatty acid esters), salts of Group 1 metals (such as $Li^+$, $Na^+$, and $K^+$ such as $LiCF_3SO_3$, $NaClO_4$, $LiAsF_6$, $LiBF_4$, NaSCN, KSCN, and NaCl), electrolytes (such as $NH^{4+}$ salts), salts of Group 2 metals (such as $Ca^{2+}$ and $Ba^{2+}$ such as $Ca(ClO_4)_2$), and these antistatic agents including at least one group including active hydrogen that reacts with isocyanates (such as a hydroxyl group, a carboxyl group, or a primary or secondary amine group). Further, examples of the conducting agent include ionic conducting agents (such as complexes of the examples described above and polyols such as 1,4-butanediol, ethylene glycol, polyethylene glycol, propylene glycol, and polyethylene glycol) derivatives thereof, or the like, and complexes of the examples described above and monools (such as ethylene glycol monomethyl ether and ethylene glycol monoethyl ether), conductive carbons (such as ketjenblack EC and acetylene black), carbons for rubbers (such as SAF, ISAF, HAF, FEF, GPF, SRF, FT, and MT), carbons for color inks that have undergone oxidization treatment, pyrolytic carbons, natural graphite, artificial graphite, metals and metal oxides (such as antimony doped tin oxide, titanium oxide, zinc oxide, nickel, copper, silver, and germanium), and conductive polymers (such as polyaniline, polypyrrole, and polyacetylene). In this case, the content of these conducting agents is appropriately selected in accordance with the kind of the composition, and is normally adjusted such that the volume resistivity of the elastic layer 31 is $10^2$ to $10^8$ Ω·cm, and more preferably $10^3$ to $10^6$ Ω·cm.

The surface layer 32 is formed from a conductive resin layer 35 in which particles P1 and P2 are dispersed as illustrated in FIG. 2B. Specific examples of a resin material constituting the conductive resin layer 35 include polyester resin, acrylic resin, urethane resin, acrylic urethane resin, nylon resin, epoxy resin, polyvinyl acetal resin, vinylidene chloride resin, fluorine resin, and silicone resin, and either of organic and aqueous resins can be used. In addition, a conducting agent can be added to the surface layer 32 to impart conductivity to the surface layer 32 or adjust the conductivity of the surface layer 32. In this case, the conducting agent is not particularly limited, and examples thereof include conductive carbons (such as kejenblack EC and acetylene black), carbons for rubbers (such as SAF, ISAF, HAF, FEF, GPF, SRF, FT, and MT), carbons for color inks that have undergone oxidization, pyrolytic carbons, natural graphite, artificial graphite, and metals and metal oxides (such as antimony doped tin oxide doped, titanium oxide, zinc oxide, nickel, copper, silver, and germanium). Further, in the case of using the conducting agent in an organic solvent, it is preferable that surface treatment such as silane coupling treatment is performed on the surface of the conducting agent in consideration of the dispersibility. In addition, the amount of addition of the conducting agent can be appropriately adjusted such that desired resistivity can be realized. It has been found that the charging is stable when the electrical resistivity of the surface layer 32 is higher than that of the elastic layer 31, therefore it is required that the volume resistivity is in the range of $10^3$ to $10^{15}$ Ω·cm, and more preferably in the range of $10^5$ to $10^{14}$ Ω·cm.

As the particles P1 and P2 added to this outermost conductive resin layer serving as the surface layer 32, urethane particles, nylon particles, acrylic resin particles, and copolymer resin particles such as acrylic styrene resin particles that are insulator particles having volume resistivity of $10^{10}$ Ω·cm or higher can be used. Other than these, silica particles and particles in which an inorganic material such as titanium oxide, zinc oxide, or tin oxide is bound by resin can be also used, and it is more preferable that pre-treatment such as silane coupling treatment is performed to improve the dispersibility similarly to the case of the conducting agent. In addition, although two kinds of particles having different particle diameters, that is, large particles P1 and small particles P2 are dispersed in the illustrated example, a single kind of particles or three or more kinds of particles may be dispersed. In addition, to control the surface texture as will be described later, for example, flat particles having low sphericity may be used.

Although how the charging roller described above is formed is not particularly limited, a method of preparing a coating material containing each component and applying this coating material by a dipping method, a spraying method, or a roller coating method to form a coating film is preferably used. In this case, when forming a plurality of outer layers, the dipping, spraying or roller coating may be repeated by using coating materials constituting the respective layers.

Description of Specific Manufacturing Method

Here, a specific method of manufacturing the charging roller 3 will be described. The manufacturing configuration that will be described below is the configuration of a charging roller of Example 1 in Table 1 that will be shown later, and although the outer diameter and content of particles therein are different from configuration examples of other charging rollers, the manufacturing method itself is the same.

First, regarding the preparation method for the elastic layer 31, 100 parts of epichlorohydrin rubber (product name: Epichlomer CG102, manufactured by Osaka Soda Co., Ltd.), 30 parts of calcium carbonate serving as filler, 2 parts of colored grade carbon (product name: Seast SO, manufactured by Tokai Carbon Co., Ltd.) serving as a reinforcing material for improving polishability, 5 parts of zinc oxide, 10 parts of dioctyl phthalate: DOP serving as a plasticizer, 3 parts of quaternary ammonium perchlorate represented by Formula (1) below, and 1 part of 2-mercaptobenzimidazole serving as an antiaging agent were kneaded for 20 minutes by an open roll kneader, then 1 part of a vulcanization accelerator DM, 0.5 part of a vulcanization accelerator TS, and 1 part of sulfur as a vulcanizing agent were further added to the system, and the system was further kneaded for 15 minutes by an open roll kneader. This was extruded into a tubular shape by a rubber extruder, then was cut, subjected to primary vulcanization for 40 minutes by water vapor of 160° C. in a vulcanizer, and thus a primary-vulcanized rubber tube for a conductive elastomer base layer was obtained.

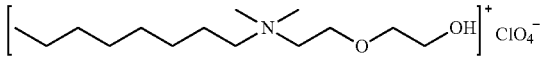

Next, a thermosetting adhesive (product name: Metaloc U-20) for metal and rubber was applied on a middle portion of a columnar surface of the support body 30 formed from steel, plated with nickel, and having a columnar shape in the axial direction thereof, and the support body 30 was dried for 30 minutes at 80° C. and then further for 1 hour at 120° C. This support body was inserted in the primary-vulcanized rubber tube for a conductive elastomer base layer, then secondary vulcanization and curing of the adhesive was performed by heating the tube and the support body for 2 hours at 160° C. in an electric oven, and thus an unpolished product was obtained. Both ends of a rubber part of the unpolished product were cut off, then the rubber part was polished by a grindstone, and thus a roller member including the elastic layer 31 having a ten point height of roughness profile Rzjis of 7 μm and a run-out of 25 μm was obtained.

Next, the surface layer 32 was formed. To 50 parts of conductive tin oxide powder (product name: SN-100P manufactured by Ishihara Sangyo Kaisha, Ltd.), 450 parts of 1% isopropyl alcohol solution of trifluoropropyltrimethoysilane and 300 parts of glass beads having an average particle diameter of 0.8 mm were added, dispersion of the system was performed for 48 hours by a paint shaker, and the dispersion was filtered by a net of 500 mesh. Next, this solution was heated in a 100° C. water bath while being stirred by a nauta mixer to volatilize and remove alcohol to dry the system, and surface-treated conductive tin oxide was obtained by adding a silane coupling agent to the surface of the system. Further, 145 parts of lactone-modified acrylic polyol (product name: Placcel DC2009, manufactured by Daicel Corporation, having a hydroxyl value of 90 KOHmg/g) was dissolved in 455 parts of methyl isobutyl ketone: MIBK to obtain a solution having solids of 24.17% by mass. With 200 parts of this acrylic polyol solution, 50 parts of the surface-treated conductive tin oxide powder, 0.01 part of silicone oil (product name: SH-28PA, manufactured by Toray Dow Corning Silicone Co, Ltd.), 1.2 parts of fine silica particles having a primary particle diameter of 0.02 μm, 4.5 parts of large-diameter particles (product name: Chemisnow MX-1000 manufactured by Soken Chemical & Engineering Co., Ltd., having an average particle diameter of 10 μm), and 18 parts of small-diameter particles (product name: Chemisnow MX-500 manufactured by Soken Chemical & Engineering Co., Ltd., having an average particle diameter of 5 μm) were mixed. To this, 200 parts of glass beads having a diameter of 0.8 mm was added, and dispersion of the system was performed for 12 hours in a 450-ml mayonnaise jar by using a paint shaker while cooling.

Further, to 330 parts of this dispersion, 27 parts of block-type isocyanurate trimer of isophorone diisocyanate: IPDI (product name: Vestanat B1370, manufactured by Degussa-Hüls), and 17 parts of isocyanurate trimer of hexamethylene diisocyanate: HDI (product name: Duranate TPA-B80E, manufactured by Asahi Kasei Corp.) were added, the mixture was stirred for 1 hour by a ball mill, finally the solution was filtrated by a net of 200 mesh, and thus a coating material for surface layer having a solid content of 43% by mass was obtained. The coating material for surface layer was applied on the surface of the roller member including the elastic layer 31 by dipping. The application was performed at a pulling speed of 400 min/min, and then the layer was air-dried for 30 minutes. After this, the axial direction was reversed, and the application was performed again at a pulling speed of 400 mm/min. Then, the layer was air-dried for 30 minutes and dried for 1 hour in an oven at 160° C., and then the layer was left to stand for 48 hours in an environment of a room temperature of 25° C. and a relative humidity of 50%.

Examples of Configurations of Charging Roller

Table 1 show configuration examples of charging rollers of the present exemplary embodiment and test results of the charging rollers.

TABLE 1

| | | | Sample No. | | | | | | | | |
|---|---|---|---|---|---|---|---|---|---|---|---|
| | | | 1 | 2 | 3 | 4 | 5 | 6 | 7 | 8 | 9 |
| Configuration | | Large particle diameter D1 [μm] | 5 | 5 | 10 | 15 | 20 | 30 | 10 | 15 | 10 |
| | | Small particle diameter D2 [μm] | — | — | 5 | 5 | 5 | 5 | — | 5 | 5 |
| | | D1/D2 | — | — | 2.0 | 3.0 | 4.0 | 6.0 | — | 3.0 | 2.0 |
| | | Large particle mixture ratio M1/(M1 + M2) | 1.00 | 1.00 | 0.08 | 0.08 | 0.15 | 0.22 | 1.00 | 0.27 | 0.60 |
| | | Amount of mixed particles (M1 + M2)/M0 | 25.0% | 42.0% | 12.0% | 64.0% | 38.0% | 38.0% | 34.0% | 38.0% | 23.6% |
| Measured value | | Average film thickness [μm] | 12 | 7 | 15 | 15 | 15 | 15 | 12 | 15 | 15 |
| | | Maximum height Sz [μm] | 3.8 | 6.7 | 11.4 | 15.8 | 17.1 | 21.0 | 7 | 15.5 | 14.9 |
| | | Autocorrelation length Sal [μm] | 16.5 | 9.8 | 15.7 | 11.4 | 15.5 | 18.0 | 13.3 | 15.4 | 20.0 |
| Image evaluation | Initial | Black dot (HT uniformity) | A | A | A | B | D | D | A | B | B |
| | After endurance test | White streak (toner soiling) | D | D | A | A | A | A | D | A | A |
| | | Black streak (external additive soiling) | A | D | A | D | B | A | B | B | A |

In the table, the items of respective rows represent the following.

"Large particle diameter D1" and "Small particle diameter D2" respectively represent average particle diameters of particles dispersed in the surface layer of the charging roller in the unit of μm. D1 corresponds to the larger particles, and D2 corresponds to smaller particles. The larger particles and the smaller particles will be referred to as large particles and small particles. To be noted, in the present exemplary embodiment, the average particle diameters are volume average particle diameters.

"D1/D2" is a ratio of the large particle diameter to the small particle diameter.

"Large particle mixture ratio" represents a mass ratio of the large particles to all the particles dispersed in the surface layer. That is, in the case where M1 represents the mass of the mixed large particles and M2 represents the mass of the mixed small particles, "Large particle mixture ratio" is M1/(M1+M2).

"Amount of mixed particles" represents the amount of all the mixed particles with respect to all the solid components in the surface layer excluding the particles by percentage. That is, in the case where a value obtained by subtracting the masses M1 and M2 of the mixed large and small particles from the total mass of the surface layer 32 is M0, the amount of mixed particles is (M1+M2)/M0×100(%).

To be noted, in the case where only a single kind of particles is mixed, the calculation regarding the large particle mixture ratio and the amount of mixed particles was performed by setting D2 and M2 to 0.

"Average film thickness" in the table represents the layer thickness of the resin material constituting the surface layer. In other words, the average film thickness represents the average thickness of the solid components of the surface layer of the charging roller in the case of ignoring projecting portions on the surface derived from the particles. The projecting portions will be also referred to as particle portions hereinbelow. Specifically, a prototype of the surface layer of the charging roller was partially cut off, and the cut-off portion was observed by a laser microscope in a direction perpendicular to the section thereof at an appropriate magnification. The laser microscope used herein was VK-X1000 manufactured by KEYENCE. Then, the average distance from an interface between the surface layer and the elastic layer to the surface of the surface layer measured by excluding the projecting portions of the surface layer derived from the particles was set as the film thickness measured in this section. To reduce the deviation of measured value depending on the observed position, the observation was performed for 9 sections. The 9 sections are respectively taken at 3 different points in the longitudinal direction and 3 different points in the rotational direction of one charging roller. The 3 different points in the longitudinal direction were respectively at the center of the charging roller in the longitudinal direction and at positions 2 cm from both end portions of the charging roller in the longitudinal direction. The 3 different points in the rotational direction were set with 120° intervals therebetween from an arbitrary position as a standard. Then, the average of film thicknesses obtained for respective sections were set as the "average film thickness" of the surface layer of the charging roller.

To be noted, in the observation of sectional images described above, the range of the "particle portions" can be determined by visual observation in the case where the boundary between the particle portions and the other portion, that is, the base portion, is clear. In the case where the boundary is not clear, a roughness profile of the surface of the surface layer is obtained from the sectional images by a method defined in JIS B0601 or ISO 4278, and portions higher than a peak value of a height frequency distribution are regarded as particle portions. In the case where a plurality of peaks are present, the lowest peak value is used.

Measurement Method for Surface Texture of Charging Roller

The maximum height Sz and the autocorrelation length Sal in Table 1, which are parameters related to areal roughness of the surface of the charging roller were obtained by the following method. First, an image of the surface of the charging roller was captured by the laser microscope VK-X1000 manufactured by KEYENCE with an objective lens of 50× magnification, and thus two-dimensional height data having an area of 273 μm (width)×204 (length) was obtained. After performing autocorrection on the curvature of the surface, the maximum height and the autocorrelation length were obtained by using a multi-file analysis application conforming to ISO 25178 manufactured by KEYENCE. To reduce the deviation of measured value depending on the observed position, the maximum height and the autocorrelation length were obtained from each of 9 images captured at 9 positions per one charging roller. The 9 images are respectively taken at 3 different points in the longitudinal direction and 3 different points in the rotational direction. The 3 different points in the longitudinal direction were respectively at the center of the charging roller in the longitudinal direction and at positions 2 cm from both end portions of the charging roller in the longitudinal direction. The 3 different points in the rotational direction were set with 120° intervals therebetween from an arbitrary position as a standard. Then, the average values of the maximum heights and autocorrelation lengths obtained at respective observation positions were set as the maximum height Sz and the autocorrelation length Sal of the surface layer of this charging roller.

Here, the maximum height Sz is a parameter representing a height difference between the highest point and the lowest point of a profile of a measurement target. In addition, the autocorrelation length Sal is obtained from an autocorrelation function concerning a surface serving as a measurement target, i.e., a scale-limited surface. The autocorrelation function is a function representing similarity between the surface serving as a measurement target and a virtual surface obtained by shifting the surface serving as a measurement target in an x-axis direction and in a y-axis direction on the premise that the height direction is a z-axis direction. The autocorrelation function is a 2-variable function including a shift amount tx in the x-axis direction and a shift amount ty in the y-axis direction as variables, and has a characteristic that the value of the autocorrelation function is 1 in the case where the original surface and the shifted virtual surface coincide with each other perfectly, that is, where tx=ty=0 holds, and becomes smaller when the deviation therebetween is larger. The autocorrelation length Sal is a parameter representing a horizontal distance in a direction in which the value of the autocorrelation function attenuates to a specific value s most quickly. In the present exemplary embodiment, the specific value s is 0.2. In other words, the autocorrelation length Sal represents a distance from an origin to a point to which the distance from the origin is the smallest among points (tx, ty) at which the value of the autocorrelation function is s or smaller.

In the case where the shape of the surface quickly changes, that is, where steep recesses and projections appear successively, the autocorrelation function quickly attenuates as the point becomes farther from the origin, and thus the value of the autocorrelation length Sal is small. In contrast, in the case where the shape of the surface is flat or smooth, the attenuation of the autocorrelation function is small, and thus the value of the autocorrelation length Sal is large. Therefore, to reduce the fine and steep recesses and projections that are one cause of external additive filming, it is effective to control the autocorrelation length Sal.

Endurance Test of Charging Roller and Evaluation Method Therefor

Next, how an endurance test of the charging roller was performed and an electrophotography apparatus used for image evaluation will be described. An electrophotographic copier used in this test was a machine for A3 horizontal output, the output speed of the recording material is 240 mm/sec, and the image resolution was 600 dpi. The image bearing member was a photosensitive drum of a reversal development system formed by coating an aluminum cylinder with an OPC layer and further coating the OPC layer with an overcoat layer. Grinded toner that had an average diameter of 6 μm, contained polyester as a main material and wax as an inner additive, and had been treated with an external additive such as silica was used as the toner. To evaluate the image after the endurance test, the copier was caused to successively output an image of an image ratio of 5% on 100 thousand sheets in an environment of low temperature and low humidity, that is, an L/L environment of 15° C. and 10% RH.

Regarding image evaluation, first, presence/absence of an image defect called black dot in a halftone image output in an initial state, that is, the uniformity of the halftone image was evaluated. The uniformity of the halftone image will be also referred to as HT uniformity. The black dot is observed in the case where, for example, the particles in the surface layer of the charging roller are too large or where the particles are not successfully dispersed and aggregates are formed, and thus serves as an index for determining whether the amount of addition of the particles is too large. It is assumed that a portion that discharges electricity and a portion that does not discharge electricity are locally formed, thus a portion having a relatively high potential and a portion having a relatively low potential are generated, and the portion having a relatively low potential appears as a prominently black portion. That is, in the case of a direct current charging system, when the sum of a reduced peak height Spk and a core height Sk is larger than 8 μm, no electrical discharge occurs because a contact nip portion between the charging roller and the photosensitive drum is equal to or smaller than 8 μm, which is the minimum gap through which Paschen discharge occurs. However, it is considered that, in the case where the degree of dispersion of the particles in the surface layer is small, the gap width exceeds 8 μm at some parts, thus an area where electrical discharge occurs increases, and locally the portion that discharges electricity and the portion that does not discharge electricity are generated.

Regarding the evaluation criteria of the black dot, a halftone image of A3 size was output on one sheet, and presence/absence of a black dot image was checked. A case where no black dot was generated was evaluated as "A", a case where the number of black dots was 4 or less and the sizes of the black dots were 0.3 mm or smaller was evaluated as "B", and a case where the number of black dots was 20 or less and the sizes of the black dots were 0.6 mm or smaller was evaluated as "C". In addition, a case where the sizes of black dots were larger than 0.6 mm or where the sizes of the black dots were equal to or smaller than 0.4 mm but the number of the black dots was more than 20 was evaluated as "D".

Next, regarding evaluation of the nonuniformity appearing as a streak shape, after the endurance test of the copier, that is, after outputting an image on 100 thousand sheets in the above conditions, the evaluation was performed by visually checking a halftone image. A case where no image defects of the streak occurred on the halftone image was evaluated as "A", a case where nonuniformity that was so subtle and could not be noticed without close observation occurred was evaluated as "B", a case where nonuniformity that was minor but could be recognized at a glance occurred was evaluated as "C", and a case where nonuniformity that clearly stood out occurred was evaluated as "D". In addition, it was determined that a streak of low density, that is, white streak on the halftone image was caused by toner filming and that a streak of high density, that is, black streak was caused by external additive filming. This is because the inventors found, from the results of other experiments, that the direction in which the charging potential changes differs depending on the cause of the filming in either case of a direct current charging system and an alternate current charging system.

In the case of the external additive filming, an experimental result indicating that the charging potential changes in a direction in which the absolute value thereof becomes smaller, that is, a direction in which the image density increases was obtained. In contrast, in the case of toner filming of the direct current charging system, the charging potential changes in a direction in which the absolute value thereof becomes larger, that is, a direction in which the image density decreases. To be noted, in the case of toner filming of the alternate current charging system, the charging potential changes in a direction in which the absolute value thereof becomes smaller due to soiling by the external additive, that is, a direction in which the image density increases, similarly to the case of the external additive filming. The reason why the effect on image changes depending on which of the external additive filming and the toner filming the filming is in the direct current charging system is not known. The reason why the absolute value of the charging potential decreases due to filming in the alternate current charging system is considered to be that an impedance Z increases due to the attached matter and the charging efficiency of the filming portion decreases. In addition, it is possible that the reason why the absolute value of the charging potential increases due to toner filming in the direct current charging system is occurrence of local abnormal electrical discharge.

Evaluation Results

Table 1 showing the results of evaluation obtained by the evaluation method described above will be described. First, a charging roller coated with a surface layer having an average film thickness of 12 μm in which a single kind of particles having an average particle diameter of 5 μm was mixed such that the mixture ratio thereof to all the solid components in the surface layer was 25% was manufactured as Example 1. The charging roller of Example 1 manufactured in this configuration was attached to a copier and caused to output a halftone image, as a result, no image defect of black dot was observed, and thus the evaluation concerning a black dot was "A". As a result of further outputting a halftone image after the endurance test of outputting 100 thousand sheets, no black streak was observed, and thus the evaluation concerning a black streak was "A". However, a white streak was observed and thus the evaluation concerning a white streak was "D".

Here, to measure the influence of the particles, charging rollers of Examples 3 to 6 containing particles having larger particle diameters than 5 μm were manufactured in addition to a charging roller of Example 2 in which the average particle diameter of a single kind of particles was set to 5 In Example 3, the large particle diameter D1 was set to 10 In Example 4, the large particle diameter D1 was set to 15 In Example 5, the large particle diameter D1 was set to 20 In Example 6, the large particle diameter D1 was set to 30 In these configuration examples, it was confirmed that there is a correlation between the maximum height Sz and the large particle diameter D1.

As a result of performing image evaluation on Examples 2 to 6, there was a tendency that the image defect of black dot became worse as the maximum height Sz became larger. In Examples 2, 3, and 4 in which Sz was smaller than 16 no image defect of black dot was observed and therefore the evaluation concerning a black dot was "B" or better. However, in Examples 5 and 6 in which Sz was larger than 16 the evaluation concerning a black dot was "D". However, regarding the image defect of white streak caused by toner filming, it was confirmed that the result was better when the maximum height Sz was larger. In Example 3, 4, 5, and 6 in which the maximum height Sz was larger than 8 the evaluation concerning a white streak improved as compared with Example 1 and became "A". However, in Example 2 in which the maximum height Sz was smaller than 8 the evaluation concerning a white streak was "D". That is, there is a trade-off relationship that, in the case where the size of the particles is increased and thus the maximum height Sz is increased, the toner filming is suppressed but that the uniformity of the initial halftone image is degraded, and it was confirmed that both of these can be maintained in a good level in the case where the maximum height Sz is in a range of 8 μm to 16 μm.

From the results of Examples 2 to 6, it was found that the average particle diameter of the large particles needs to be 15 μm or smaller. In addition, to make the maximum height Sz be 8 μm or larger, which is a value that can effectively suppress the toner filming, by using such particles, it is required that at least part of the particles project from the resin layer without being completely buried in the resin material constituting the surface layer. For example, in the section of the surface layer described in the measurement method for the average film thickness of the surface layer, at least part of the particles project to the outer periphery side preferably by 4 μm or more and more preferably 5 μm or more from a height position calculated as the film thickness of the surface layer. In addition, mixing particles having an average particle diameter within a range of 2 μm or larger and 15 μm or smaller while limiting the average film thickness of the surface layer to 20 μm or smaller was effective for securing the amount of projection of the particles.

In addition, among these configuration examples, the evaluation concerning the image defect of black streak caused by the external additive filming was "D" in Examples 2 and 4. Observing these charging rollers after the endurance test by an optical microscope, accumulation of the external additive in fine recesses, wrinkles and the vicinity of the particle portions in the surface was observed, and it was assumed that the external additive filming became worse in the charging rollers of Examples 2 and 4 due to such steep shapes.

Such quick change in the surface shape can be evaluated by using the autocorrelation length Sal as described above. Actually, the charging rollers of Examples 1, 3, 5, and 6 in which the results of evaluation concerning the external additive filming were "A" or "B" had Sal larger than 13 and the charging rollers of Examples 2 an 4 in which the results of evaluation concerning the external additive filming were "D" had Sal smaller than 13 μm.

Further, to check the influence of the autocorrelation length Sal on the external additive filming, charging rollers of Examples 7 to 9 were manufactured. These configuration examples were based on the configurations of Examples 2 and 4 in which the results of evaluation concerning the external additive filming were "D", and were set such that the autocorrelation length Sal became larger than 13 μm while maintaining the maximum height Sz in a similar level to these.

First, Example 7 was set such that the surface shape in the vicinity of the particles was not steep by increasing the particle diameter from 5 μm to 10 μm and the film thickness of the surface layer from 7 μm to 12 μm from Example 2. The autocorrelation length Sal of the charging roller of Example 7 was 13.3 Next, in Examples 8 and 9, the configuration or manufacturing method thereof were changed from Example 4 such that the autocorrelation length Sal was increased. Regarding the changed points, the large particle diameter D1 or the small particle diameter D2 and the amount of mixed particles shown in Table 1 were changed, and a method of changing the degree of dispersion of the particles in the coating material for surface layer or a method of changing the volatility of the coating material for surface layer after being applied on the elastic layer was used. The autocorrelation length Sal was 15.4 μm in the charging roller of Example 8 and 20.0 μm in the charging roller of Example 9.

Image evaluation was performed on Examples 7 to 9, and as a result, the evaluation concerning the image defect of black streak was "B" or better. As can be seen from these results, it was found that setting the autocorrelation length Sal to a large value is effective for suppressing the external additive filming of the charging roller. However, if Sal is too larger, the unevenness of the charging roller decreases too much, and the contact area between the charging roller and the photosensitive drum increases. Therefore, there is a tendency that toner contamination becomes worse. Hence, in these examples, Sal is set to be smaller than 30 It is more preferable that Sal is set to be equal to or smaller than 25 μm.

In addition, it was found that it is preferable that the amount of mixed particles is not too large, for example, 50% or less, with respect to the solid components of the surface layer from the results that, in Example 4 in which the amount of mixed particles with respect to the solid components of the surface layer was large, the autocorrelation length Sal was smaller than 13 μm and the external additive filming occurred. Further, regarding the average particle diameters D1 and D2 of the large particles serving as first particles and the small particles serving as second particles, it was found that a good result is obtained in the case where relationships of $5<D1<20$ and $3<D2\leq(D1)/2$ are satisfied.

As described above, according to these examples, it was found that it is important that, regarding the areal roughness of the charging roller, values of the maximum height Sz and the autocorrelation length Sal obtained by a measurement method conforming to ISO 25178 are within specific ranges. That is, the uniformity of the charging potential is secured and the occurrence of toner filming and external additive filming can be suppressed in the case where these variables satisfy relationships of $8\leq Sz\leq 16$ and $Sal\geq 13$. As a result of this, it has become possible to provide a charging roller capable of maintaining good image quality for a long period of time. Such a charging roller can be preferably used with a developer including a toner having an average particle diameter of 10 μm or smaller and an external additive having a volume average particle diameter serving as primary particle diameter of 0.5 μm or smaller in an electrophotography apparatus.

In addition, from the results of tests described above, it was found that better evaluation can be obtained in the case where relationships of $11.4\leq Sz$ and $Sal\geq 15.5$ are satisfied as can be seen from Examples 3 and 9 of Table 1.

As has been described above, according to the present invention, good image quality can be maintained for a long period of time.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-091550, filed on May 10, 2018, which is hereby incorporated by reference herein in its entirety.

What is claimed is:

1. An image forming apparatus comprising:

an image bearing member configured to bear an image; and a charging roller to which a direct current voltage is applied and which is configured to charge a surface of the image bearing member, wherein the charging roller comprises a shaft member, an elastic layer formed around the shaft member, and a surface layer formed around the elastic layer, wherein particles having particle diameters of 2 μm to 15 μm are dispersed in the surface layer, and wherein a maximum height Sz (μm) and an autocorrelation length Sal (μm) with respect to the surface layer of the charging roller satisfy $8<Sz<16$ and $13<Sal<30$.

2. The image forming apparatus according to claim 1, wherein the maximum height Sz and the autocorrelation length Sal further satisfy $11.4<Sz$ and $15.5<Sal<25$.

3. The image forming apparatus according to claim 1, wherein an average film thickness of the surface layer is 20 μm or smaller.

4. The image forming apparatus according to claim 1, wherein at least a part of the particles project by 4 μm or more with respect to an area of a surface of the surface layer where the particles are absent.

5. The image forming apparatus according to claim 1, wherein a ratio of a mass of the particles comprised in the surface layer to a mass of the surface layer excluding the particles is 50% or smaller.

6. The image forming apparatus according to claim 1, further comprising a developing unit configured to develop an electrostatic latent image borne on the image bearing member by using developer, wherein an average particle diameter of toner contained in the developer is 10 μm or smaller, and wherein an average particle diameter of an external additive contained in the developer is 0.5 μm or smaller.

7. An image forming apparatus comprising:

an image bearing member configured to bear an image; and a charging roller to which a direct current voltage is applied and which is configured to charge a surface of the image bearing member, wherein the charging roller comprises a shaft member, an elastic layer formed around the shaft member, and a surface layer formed around the elastic layer, wherein first particles having an average particle diameter D1 (μm) and second particles having an average particle diameter D2 (μm) smaller than D1 are dispersed in the surface layer, wherein a pair (D1, D2) of the average particle diameter D1 of the first particles and the average particle diameter D2 of the second particles satisfies $D1<20$ and $3<D2<(D1)/2$ simultaneously, and wherein a maximum height Sz (μm) and an autocorrelation length Sal (μm) with respect to the surface layer of the charging roller satisfy $8<Sz<16$ and $13<Sal<30$.

8. The image forming apparatus according to claim 7, wherein the maximum height Sz and the autocorrelation length Sal further satisfy $11.4<Sz$ and $15.5<Sal<25$.

9. The image forming apparatus according to claim 7, wherein an average film thickness of the surface layer is 20 μm or smaller.

10. The image forming apparatus according to claim 7, wherein at least a part of the first and second particles project by 4 μm or more with respect to an area of a surface of the surface layer where the first and second particles are absent.

11. The image forming apparatus according to claim 7, wherein a ratio of a mass of the first and second particles comprised in the surface layer to a mass of the surface layer excluding the first and second particles is 50% or smaller.

12. The image forming apparatus according to claim 7, further comprising a developing unit configured to develop an electrostatic latent image borne on the image bearing member by using developer, wherein an average particle diameter of toner contained in the developer is 10 μm or smaller, and wherein an average particle diameter of an external additive contained in the developer is 0.5 μm or smaller.

* * * * *